US012601494B2

(12) United States Patent
Luo et al.

(10) Patent No.: US 12,601,494 B2
(45) Date of Patent: Apr. 14, 2026

(54) LOW-SMOKE CARBON FURNACE

(71) Applicant: Yotrio Group Co., Ltd., Linhai (CN)

(72) Inventors: Huian Luo, Linhai (CN); Jianqiang Xie, Linhai (CN)

(73) Assignee: Yotrio Group Co. Ltd., Linhai (CN)

( * ) Notice: Subject to any disclaimer, the term of this patent is extended or adjusted under 35 U.S.C. 154(b) by 449 days.

(21) Appl. No.: 18/220,264

(22) Filed: Jul. 11, 2023

(65) Prior Publication Data

US 2024/0288172 A1 Aug. 29, 2024

(51) Int. Cl.

| | |
|---|---|
| ***F24B 1/181*** | (2006.01) |
| ***F24B 5/02*** | (2006.01) |
| ***F24B 13/00*** | (2006.01) |
| ***F24B 13/02*** | (2006.01) |

(52) U.S. Cl.

CPC ..... *F24B 1/181* (2013.01); *F24B 5/026* (2013.01); *F24B 13/008* (2013.01); *F24B 13/02* (2013.01)

(58) Field of Classification Search

CPC ..... F24B 1/181; F24B 5/026; F24B 13/02; F24B 13/008; F24B 1/19

See application file for complete search history.

(56) References Cited

U.S. PATENT DOCUMENTS

| | | | | |
|---|---|---|---|---|
| 5,622,161 | A * | 4/1997 | Stack | F24B 5/026 126/77 |
| 5,651,356 | A * | 7/1997 | Kaines | A47J 27/026 126/261 |
| 11,092,342 | B2 * | 8/2021 | Harrington | F24B 13/006 |
| 11,378,279 | B2 * | 7/2022 | Jan | F24C 15/36 |
| 12,359,817 | B2 * | 7/2025 | Weilert | F24B 1/181 |
| 2019/0277503 | A1 * | 9/2019 | Semerad | F23B 10/00 |
| 2020/0096199 | A1 * | 3/2020 | Harrington | F24B 5/025 |
| 2020/0208842 | A1 * | 7/2020 | Jan | F24B 1/182 |
| 2020/0309369 | A1 * | 10/2020 | Jan | F23H 17/08 |
| 2021/0048188 | A1 * | 2/2021 | Harrington | F23B 20/00 |
| 2022/0252270 | A1 * | 8/2022 | Weilert | F24B 5/026 |
| 2022/0364732 | A1 * | 11/2022 | Ressler | F24C 1/16 |
| 2023/0099933 | A1 * | 3/2023 | Weilert | F24C 1/06 126/25 R |
| 2024/0023754 | A1 * | 1/2024 | Zhang | F24B 5/08 |
| 2024/0263798 | A1 * | 8/2024 | Zeng | F24B 3/00 |

* cited by examiner

*Primary Examiner* — Ko-Wei Lin

(74) *Attorney, Agent, or Firm* — Jingming (James) Cai; SAC Attorneys LLP

(57) ABSTRACT

A low-smoke carbon furnace including an outer casing, a removable liner, and an annular interlayer is provided. The removable liner is disposed in the outer casing. The removable liner is provided with a combustion chamber therewithin. The removable liner includes multiple secondary air inlets disposed on an upper side wall of the removable liner. The annular interlayer is disposed between the outer casing and the removable liner. A bottom end of the outer casing is provided with interlayer air inlets that communicate with the annular interlayer. Oxygen enters the annular interlayer via the interlayer air inlets, and thereafter enters the combustion chamber of the removable liner via the secondary air inlets to facilitate secondary combustion in the combustion chamber.

9 Claims, 3 Drawing Sheets

LOW-SMOKE CARBON FURNACE

CROSS-REFERENCE TO RELATED APPLICATIONS

This application claims priority to and the benefit of the patent application titled "A low-smoke carbon furnace", application number 2023203043060, filed in the China National Intellectual Property Administration on Feb. 24, 2023. The specification of the above-referenced patent application is incorporated herein by reference in its entirety.

FIELD OF THE INVENTION

The present invention, in general, relates to carbon furnaces, and in particular, relates to a low-smoke carbon furnace.

BACKGROUND

A furnace is used for heating and cooking. In daily use, a furnace, typically, generates a large amount of smoke and fills a room with the smell of smoke. When the smell of smoke gets too strong, it makes it difficult to stay in the room and requires windows to be opened for ventilation and fresh air, which affects the functions of the furnace.

Conventional carbon furnaces are typically provided with a primary air inlet channel only, which does not allow a reasonable air intake based on the volume of a combustion chamber in the carbon furnace, which causes incomplete combustion, generates a large amount of smoke, and provides poor user experiences.

SUMMARY OF THE INVENTION

To address the above-recited problems, the present invention provides a low-smoke carbon furnace configured to substantially reduce smoke generated by combustion by facilitating a secondary combustion of unburned fuels in the carbon furnace and combusting fuels completely through a secondary air intake. The low-smoke carbon furnace comprises an outer casing, a removable liner disposed in the outer casing, and an annular interlayer disposed between the outer casing and the removable liner. The removable liner is provided with a combustion chamber therewithin. The removable liner comprises multiple secondary air inlets disposed on an upper side wall of the removable liner. A bottom end of the outer casing is provided with interlayer air inlets configured to communicate with the annular interlayer. Oxygen enters the annular interlayer via the interlayer air inlets, and thereafter enters the top of the combustion chamber of the removable liner via the secondary air inlets to facilitate the secondary combustion in the combustion chamber.

In an embodiment, the low-smoke carbon furnace further comprises a bottom ring attached to the bottom end of the outer casing. The bottom ring comprises multiple primary air inlets disposed on a side wall of the bottom ring. Oxygen enters the combustion chamber from the primary air inlets via a lower end of the removable liner.

In an embodiment, the removable liner is a cylindrical structure with an opening defined at an upper end of the removable liner. The opening at the upper end of the removable liner is configured to extend outward to form an outer edge.

In an embodiment, the outer casing is a cylindrical structure with a top end in fluid communication with the bottom end of the outer casing. The top end of the outer casing is provided with a first inner edge configured to be clamped or fixed to the outer edge at the upper end of the removable liner. The bottom end of the outer casing is provided with a second inner edge configured to be fixed to an upper end face of the bottom ring using screws. The interlayer air inlets are disposed on the second inner edge at the bottom end of the outer casing.

In an embodiment, the low-smoke carbon furnace further comprises a carbon net provided internally in the removable liner. The carbon net is fixed to an inner wall of the removable liner through a connecting piece. The carbon net comprises multiple air inlet through openings disposed proximal to the lower end of the removable liner. In an embodiment, the low-smoke carbon furnace further comprises an ash collecting pot disposed below the carbon net. The ash collecting pot is fixed to a bottom wall of the removable liner using multiple supports disposed at the lower end of the removable liner.

In an embodiment, the area of the ash collecting pot is larger than the area of the air inlet through openings of the carbon net disposed proximal to the lower end of the removable liner. Furthermore, the area of the ash collecting pot is smaller than the area of the carbon net. A height space is defined between the ash collecting pot and the carbon net.

In an embodiment, the low-smoke carbon furnace further comprises a waterproof cover and a fire concentrating ring. The waterproof cover is disposed on the top end of the outer casing. The fire concentrating ring is disposed between the top end of the outer casing and the waterproof cover. An outer diameter of the fire concentrating ring is larger than an outer diameter of the outer casing. An inner diameter of the fire concentrating ring is smaller than an inner diameter of the removable liner.

In an embodiment, the fire concentrating ring comprises a first clamping ring and a second clamping ring. The fire concentrating ring is clamped to the top end of the outer casing through the first clamping ring. The fire concentrating ring is configured to support the waterproof cover through the second clamping ring.

In an embodiment, the low-smoke carbon furnace further comprises an explosion-proof net cover disposed above the waterproof cover. The explosion-proof net cover is configured to cover the top end of the outer casing through the first clamping ring of the fire concentrating ring.

The annular interlayer is configured to match and communicate with the secondary air inlets and the interlayer air inlets, forming a secondary air intake channel for oxygen, which provides secondary air for the secondary combustion of unburned fuels in the combustion chamber, so that the combustion of the fuels is sufficient and smoke generated by the combustion is reduced to the greatest extent.

The arrangement of the fire concentrating ring at the top end of the outer casing, and the structure of the fire concentrating ring having an outer diameter larger than that of the outer casing, and an inner diameter smaller than that of the removable liner, allow the fire concentrating ring to shield part of the unburned carbon monoxide and reduce smoke emissions.

In the figures: 100—low-smoke carbon furnace, 1—explosion-proof net cover, 2—waterproof cover, 3—fire concentrating ring, 31—first clamping ring, 32—second clamping ring, 4—carbon net, 41—air inlet through openings, 5—ash collecting pot, 6—removable liner, 61—secondary air inlets, 62—outer edge, 7—supports, 8—outer casing, 81—first inner edge, 82—second inner edge, 83—interlayer air inlets, 9—bottom ring, 91—primary air inlets, 10—connecting piece, 11—annular interlayer, and 12—combustion chamber.

DETAILED DESCRIPTION OF THE INVENTION

A low-smoke carbon furnace 100 of the present invention is further described below with reference to the drawings.

Figure 1:
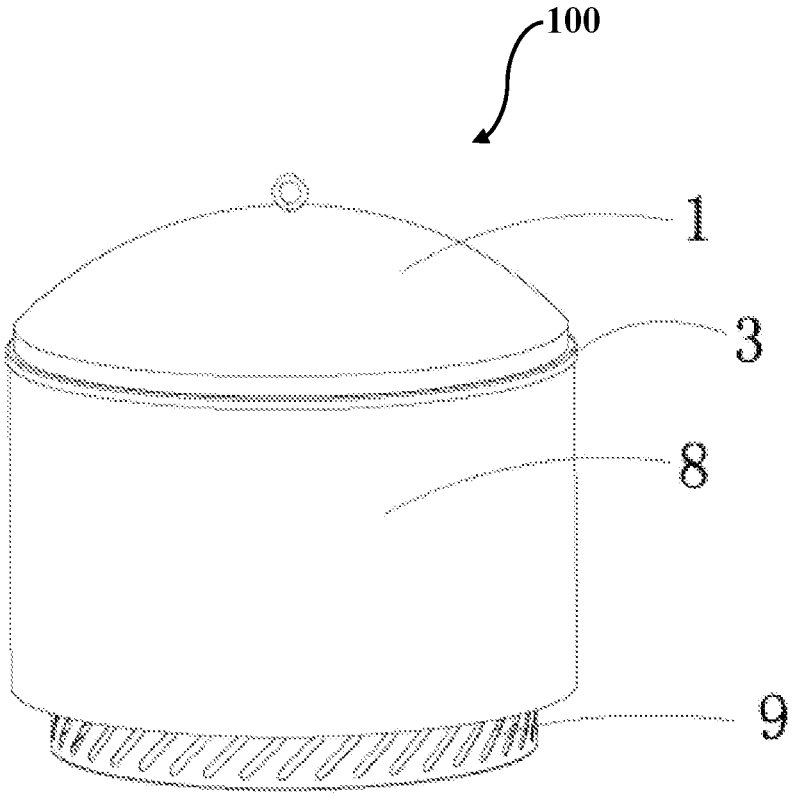
FIG. 1 is a structural diagram of a low-smoke carbon furnace.
Figure 2:
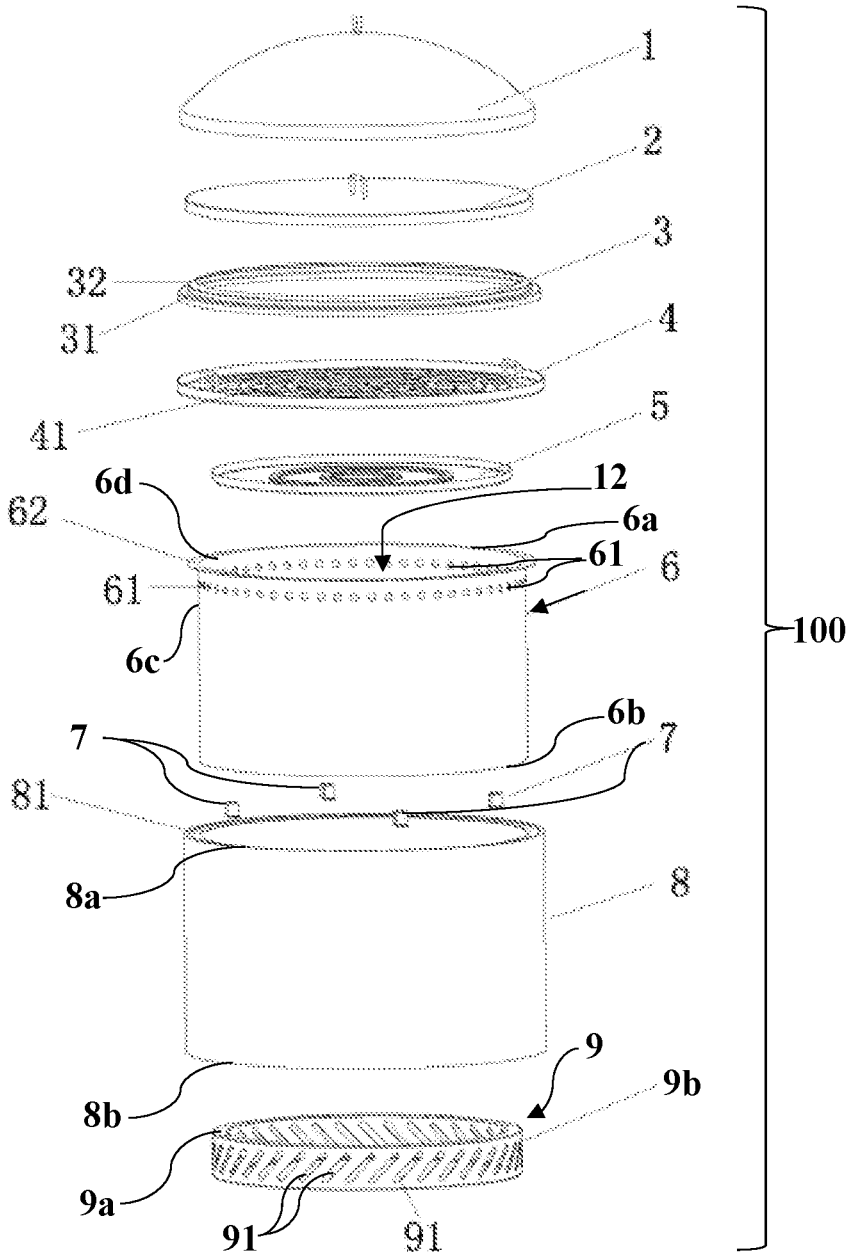
FIG. 2 is an exploded view of the low-smoke carbon furnace.
Figure 3:
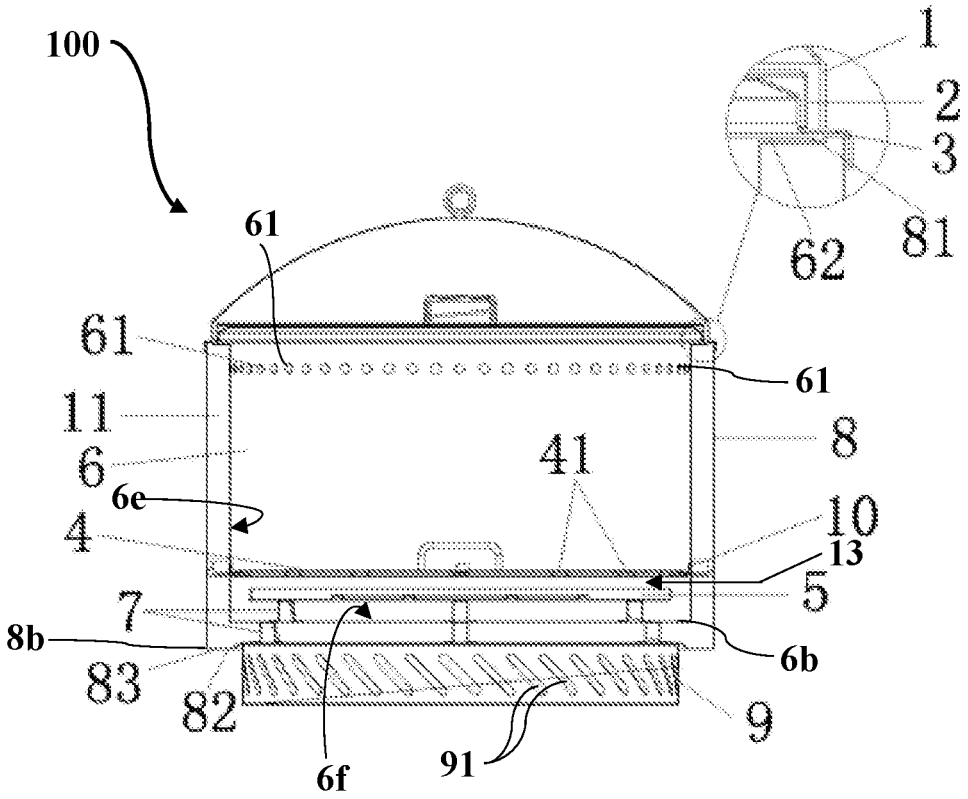
FIG. 3 is a sectional view of the low-smoke carbon furnace.

As shown in FIG. 1 to FIG. 3, the low-smoke carbon furnace 100 comprises an outer casing 8, a removable liner 6, and an annular interlayer 11. The removable liner 6 is disposed in the outer casing 8. A combustion chamber 12 shown in FIG. 2, is disposed in the removable liner 6. The annular interlayer 11 is disposed between the outer casing 8 and the removable liner 6 for secondary air intake. The removable liner 6 comprises multiple secondary air inlets 61 disposed on an upper side wall 6*c* of the removable liner 6 as shown in FIGS. 2-3. In an embodiment, the outer casing 8 is a cylindrical structure with a top end 8*a* and a bottom end 8*b* as shown in FIG. 2. The top end 8*a* of the outer casing 8 is in fluid communication with the bottom end 8*b* of the outer casing 8. The top end 8*a* of the outer casing 8 is provided with a first inner edge 81 configured to be clamped or fixed to an outer edge 62 at an upper end 6*a* of the removable liner 6. The bottom end 8*b* of the outer casing 8 is provided with a second inner edge 82 configured to be fixed to an upper end face 9*a* of a bottom ring 9. The bottom ring 9 is attached to the bottom end 8*b* of the outer casing 8 as shown in FIGS. 1-3. The second inner edge 82 at the bottom end 8*b* of the outer casing 8 is provided with interlayer air inlets 83 shown in FIG. 3, configured to match and communicate with the annular interlayer 11, so that oxygen can enter the combustion chamber 12 of the removable liner 6 through the secondary air inlets 61 after entering the annular interlayer 11 via the interlayer air inlets 83 to facilitate secondary combustion in the combustion chamber 12. In addition, a side wall 9*b* of the bottom ring 9 is provided with multiple primary air inlets 91. Oxygen enters the combustion chamber 12 from the primary air inlets 91 via a lower end 6*b* of the removable liner 6.

In an embodiment, the removable liner 6 is a cylindrical structure with an opening 6*d* defined at an upper end 6*a* of the removable liner 6. The opening 6*d* at the upper end 6*a* of the removable liner 6 is configured to extend outward to form the outer edge 62 of the removable liner 6. In an embodiment, the low-smoke carbon furnace 100 further comprises a carbon net 4 disposed in the removable liner 6. The carbon net 4 is fixed to an inner wall 6*e* of the removable liner 6 through connecting pieces 10 as shown in FIG. 3. In an embodiment, the connecting piece 10 is an L-shaped frame, where one side wall of each connecting piece 10 is fixed to the inner wall 6*e* of the removable liner 6, and the other side wall of each connecting piece 10 is configured to support and clamp the carbon net 4. The carbon net 4 comprises multiple air inlet through openings 41 disposed proximal to the lower end 6*b* of the removable liner 6 as shown in FIG. 3. Oxygen from the primary air inlets 91 of the bottom ring 9 enters the combustion chamber 12 via the air inlet through openings 41 at the lower end 6*b* of the removable liner 6. In an embodiment, the low-smoke carbon furnace 100 further comprises an ash collecting pot 5 disposed below the carbon net 4. The ash collecting pot 5 is fixed to a bottom wall 6*f* of the removable liner 6 using multiple supports 7 disposed at the lower end 6*b* of the removable liner 6. The area of the ash collecting pot 5 is larger than the area of the air inlet through openings 41 of the carbon net 4 disposed proximal to the lower end 6*b* of the removable liner 6 to prevent charcoal ash from falling out of the low-smoke carbon furnace 100 through the removable liner 6. The area of the ash collecting pot 5 is smaller than the area of the carbon net 4. The ash collecting pot 5 and the carbon net 4 have a certain height difference to reserve a certain space 13 for air intake. That is, a height space 13 is defined between the ash collecting pot 5 and the carbon net 4 as shown in FIG. 3.

Air enters the combustion chamber 12 from the air inlet through openings 41 at the lower end 6*b* of the removable liner 6 via the primary air inlets 91 to facilitate primary combustion on the carbon net 4. With regard to carbon monoxide in the upper part of the combustion chamber 12 generated by unburned fuels, oxygen enters the combustion chamber 12 through the secondary air inlets 61 after passing through the annular interlayer 11, so that: (a) the carbon monoxide is converted into carbon dioxide after sufficient secondary combustion, (b) flue gas generated by combustion is reduced, and (c) pollution is reduced, while the purpose of heating is achieved.

In an embodiment, the low-smoke carbon furnace 100 further comprises a waterproof cover 2 and a fire concentrating ring 3. The waterproof cover 2 is disposed on the top end 8*a* of the outer casing 8. The fire concentrating ring 3 is disposed between the top end 8*a* of the outer casing 8 and the waterproof cover 2. The outer diameter of the fire concentrating ring 3 is larger than the outer diameter of the outer casing 8. The inner diameter of the fire concentrating ring 3 is smaller than the inner diameter of the removable liner 6. In an embodiment, the fire concentrating ring 3 comprises a first clamping ring 31 and a second clamping ring 32 as shown in FIG. 2. The fire concentrating ring 3 is clamped to the top end 8*a* of the outer casing 8 through the first clamping ring 31. The fire concentrating ring 3 is configured to support the waterproof cover 2 through the second clamping ring 32. That is, the waterproof cover 2 is disposed on the second clamping ring 32 of the fire concentrating ring 3. In an embodiment, the low-smoke carbon furnace 100 further comprises an explosion-proof net cover 1 disposed above the waterproof cover 2. The explosion-proof net cover 1 is configured to cover the top end 8*a* of the outer casing 8 through the first clamping ring 31 of the fire concentrating ring 3. That is, the explosion-proof net cover 1 is covered on the back of the first clamping ring 31, which ensures that some carbon monoxide generated by insufficient burning is shielded by the fire concentrating ring 3 and the flue gas emissions are reduced.

It shall be noted that the above embodiments have been provided only for illustrating the technical scheme of the present invention and not to limit the present invention. Although the present invention has been described with reference to the above embodiments, those ordinarily skilled in the art should understand that they can still modify the technical scheme recorded in the foregoing embodiments, or perform equivalent replacements on some or all of the technical features; however, such modifications or replacements do not separate the essence of technical schemes from the substance and scope of the technical schemes provided by the embodiments of the present invention.

We claim:

1. A low-smoke carbon furnace comprising:

an outer casing;

a removable liner disposed in the outer casing, wherein the removable liner is provided with a combustion chamber therewithin, and wherein the removable liner comprises a plurality of secondary air inlets disposed on an upper side wall of the removable liner;

an annular interlayer disposed between the outer casing and the removable liner, wherein a bottom end of the outer casing is provided with interlayer air inlets configured to communicate with the annular interlayer, and wherein oxygen enters the annular interlayer via the interlayer air inlets, and thereafter enters the combustion chamber of the removable liner via the plurality of secondary air inlets to facilitate secondary combustion in the combustion chamber;

a waterproof cover disposed on a top end of the outer casing; and a fire concentrating ring disposed between the top end of the outer casing and the waterproof cover, wherein an outer diameter of the fire concentrating ring is larger than an outer diameter of the outer casing, and wherein an inner diameter of the fire concentrating ring is smaller than an inner diameter of the removable liner.

2. The low-smoke carbon furnace according to claim 1, further comprising a bottom ring attached to the bottom end of the outer casing, wherein the bottom ring comprises a plurality of primary air inlets disposed on a side wall of the bottom ring, wherein oxygen enters the combustion chamber from the plurality of primary air inlets via a lower end of the removable liner.

3. The low-smoke carbon furnace according to claim 2, wherein the removable liner is a cylindrical structure with an opening defined at an upper end of the removable liner, wherein the opening at the upper end of the removable liner is configured to extend outward to form an outer edge of the removable layer.

4. The low-smoke carbon furnace according to claim 3, wherein the top end of the outer casing is in fluid communication with the bottom end of the outer casing, wherein the top end of the outer casing is provided with a first inner edge, and the bottom end of the outer casing is provided with a second inner edge, wherein the first inner edge is configured to be fixed to the outer edge of the removable liner, wherein the second inner edge is configured to be fixed to an upper end face of the bottom ring, and wherein the interlayer air inlets are disposed on the second inner edge.

5. The low-smoke carbon furnace according to claim 1, further comprising a net, wherein the net is fixed to an inner wall of the removable liner through a connecting piece, and wherein the net comprises a plurality of air inlet through openings disposed proximal to a lower end of the removable liner.

6. The low-smoke carbon furnace according to claim 5, further comprising an ash collecting pot disposed below the net, wherein the ash collecting pot is fixed to a bottom wall of the removable liner using a plurality of supports disposed at the lower end of the removable liner.

7. The low-smoke carbon furnace according to claim 6, wherein area of the ash collecting pot is smaller than area of the net, and wherein a height space is defined between the ash collecting pot and the net.

8. The low-smoke carbon furnace according to claim 1, wherein the fire concentrating ring comprises a first clamping ring and a second clamping ring, wherein the fire concentrating ring is clamped to the top end of the outer casing through the first clamping ring, and wherein the fire concentrating ring is configured to support the waterproof cover through the second clamping ring.

9. The low-smoke carbon furnace according to claim 8, further comprising an explosion-proof net cover disposed above the waterproof cover, wherein the explosion-proof net cover is configured to cover the top end of the outer casing through the first clamping ring of the fire concentrating ring.

* * * * *